US009044053B1

(12) United States Patent
Osatchuck

(10) Patent No.: US 9,044,053 B1
(45) Date of Patent: Jun. 2, 2015

(54) KNEE-SPACING GARMENT ASSEMBLY

(71) Applicant: David M. Osatchuck, Auburn, PA (US)

(72) Inventor: David M. Osatchuck, Auburn, PA (US)

( * ) Notice: Subject to any disclaimer, the term of this patent is extended or adjusted under 35 U.S.C. 154(b) by 48 days.

(21) Appl. No.: 13/889,726

(22) Filed: May 8, 2013

(51) Int. Cl.
*A41D 13/00* (2006.01)

(52) U.S. Cl.
CPC ..... *A41D 13/0012* (2013.01)

(58) Field of Classification Search
CPC ..... A41D 13/00; A41D 1/00; A41D 1/06; A41D 1/067; A41D 1/08; A41D 10/00; A41D 11/00; A41D 13/0005; A41D 13/0015; A41D 13/015; A41D 13/02; A41D 13/05; A41D 13/0543; A41D 13/06; A41D 13/065; A41D 27/20; A41D 27/202; A41D 31/0044; A41D 31/005; A41D 31/02
USPC ..... 2/227, 228, 269, 22–24, 69, 247–251
See application file for complete search history.

(56) References Cited

U.S. PATENT DOCUMENTS

| | | | | | |
|---|---|---|---|---|---|
| 1,654,452 | A * | 12/1927 | Bradley | 2/227 |
| 2,568,083 | A * | 9/1951 | Mitchell | 2/231 |
| 3,168,746 | A * | 2/1965 | Smith | 2/24 |
| 4,561,124 | A * | 12/1985 | Thompson | 2/23 |
| 4,831,666 | A * | 5/1989 | Denman | 2/23 |
| 5,052,052 | A * | 10/1991 | Gilford et al. | 2/467 |
| 5,105,473 | A * | 4/1992 | Valtakari | 2/461 |
| 5,123,407 | A * | 6/1992 | Dewhurst | 602/2 |
| 5,134,726 | A * | 8/1992 | Ross | 2/465 |
| 5,377,693 | A * | 1/1995 | Loper et al. | 128/845 |
| 5,664,271 | A * | 9/1997 | Bellavance | 5/632 |
| 6,145,508 | A | 11/2000 | Seip, Jr. | |
| 6,327,713 | B1 * | 12/2001 | Gomez | 2/227 |
| 7,089,596 | B2 * | 8/2006 | Leflet et al. | 2/23 |
| 7,089,598 | B2 * | 8/2006 | Sallas et al. | 2/79 |
| D571,078 | S | 6/2008 | Kadel | |
| D645,229 | S | 9/2011 | Gagnier | |
| 8,108,945 | B2 * | 2/2012 | Sanchez | 2/24 |
| 8,166,570 | B2 * | 5/2012 | Matuszak et al. | 2/23 |
| D663,924 | S | 7/2012 | Mullen | |
| 2003/0005505 | A1 * | 1/2003 | DeMott | 2/23 |
| 2005/0060782 | A1 * | 3/2005 | Sallas et al. | 2/23 |
| 2005/0268370 | A1 * | 12/2005 | Frieler et al. | 2/24 |
| 2007/0044195 | A1 * | 3/2007 | Atkinson | 2/24 |
| 2008/0289072 | A1 * | 11/2008 | Shin | 2/23 |
| 2009/0144873 | A1 * | 6/2009 | Jewell et al. | 2/24 |
| 2009/0293167 | A1 * | 12/2009 | Kottler | 2/23 |
| 2010/0235960 | A1 * | 9/2010 | Johnson | 2/23 |
| 2010/0313322 | A1 * | 12/2010 | Sanchez et al. | 2/24 |
| 2011/0219510 | A1 * | 9/2011 | Nuzzo | 2/16 |
| 2012/0131729 | A1 * | 5/2012 | Hernandez | 2/410 |

* cited by examiner

*Primary Examiner* — Gloria Hale

(57) ABSTRACT

A knee-spacing garment assembly provides space between knees of a user using wedges that remain in place while the user changes position. The assembly includes a main section having a front portion coupled to a back portion. The main section has a top opening. Each of a pair of pant legs has an open top end coupled to the main section and an open bottom end positioned opposite an associated one of the top ends. The main section and the pant legs define a garment. A pocket is coupled to each of the pant legs. The pockets are coupled to an inner side of an exterior surface of the pant legs. A wedge is positioned in each of the pockets wherein the wedges are configured to facilitate spacing between the user's knees when the wedges are positioned in the pockets and the garment is worn on the user's lower body.

12 Claims, 4 Drawing Sheets

KNEE-SPACING GARMENT ASSEMBLY

BACKGROUND OF THE DISCLOSURE

Field of the Disclosure

The disclosure relates to garment assemblies and more particularly pertains to a new garment assembly for providing space between knees of a user through use of wedges that remain in place even as the user changes position.

SUMMARY OF THE DISCLOSURE

An embodiment of the disclosure meets the needs presented above by generally comprising a main section having a front portion coupled to a back portion. The main section has a top opening. Each of a pair of pant legs has an open top end coupled to the main section and an open bottom end positioned opposite an associated one of the top ends. The main section and the pant legs define a garment. A pocket is coupled to each of the pant legs. The pockets are coupled to an inner side of an exterior surface of the pant legs. A wedge is positioned in each of the pockets wherein the wedges are configured to facilitate spacing between the user's knees when the wedges are positioned in the pockets and the garment is worn on the user's lower body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
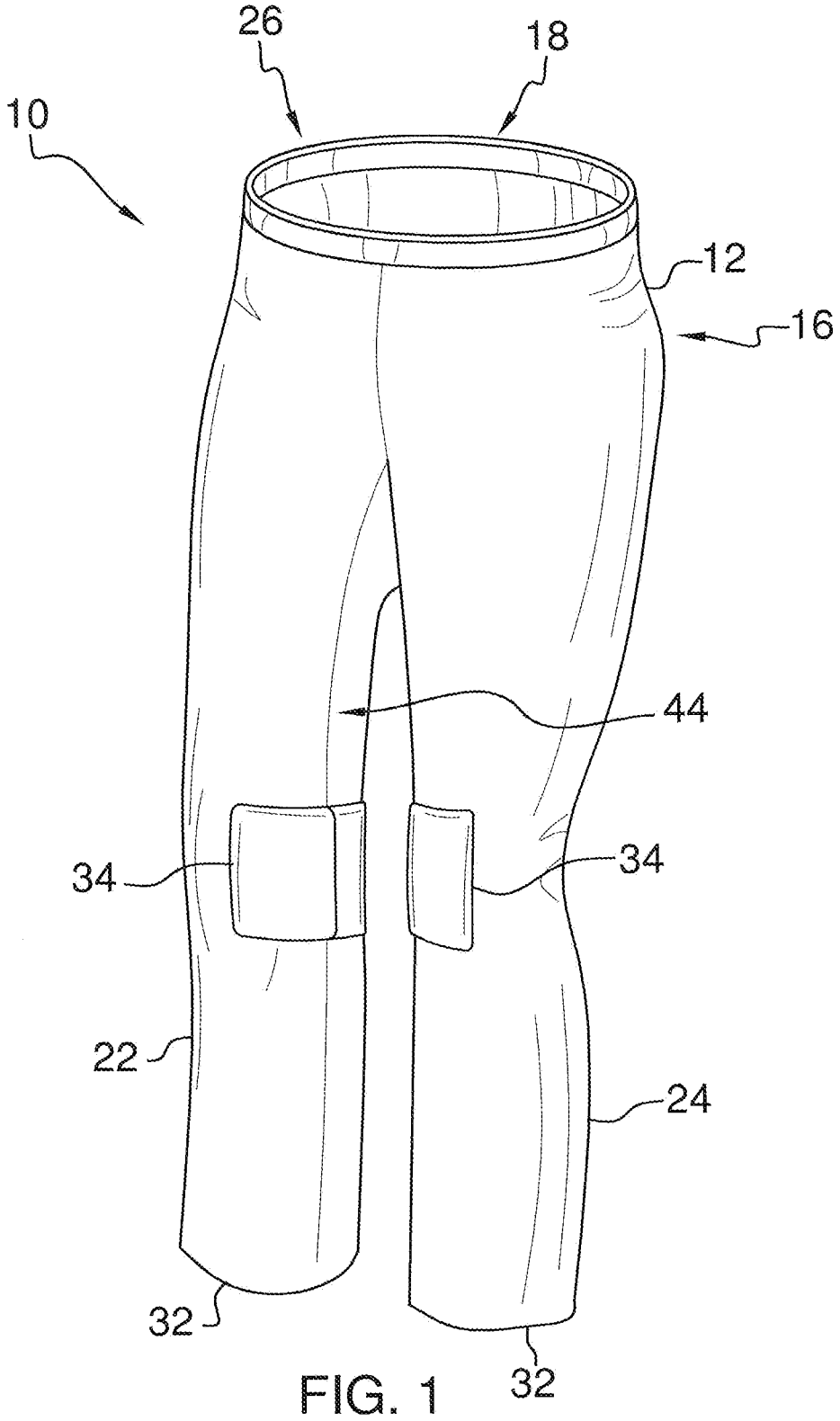
FIG. 1 is a top front side perspective view of a knee-spacing garment assembly according to an embodiment of the disclosure.
Figure 2:
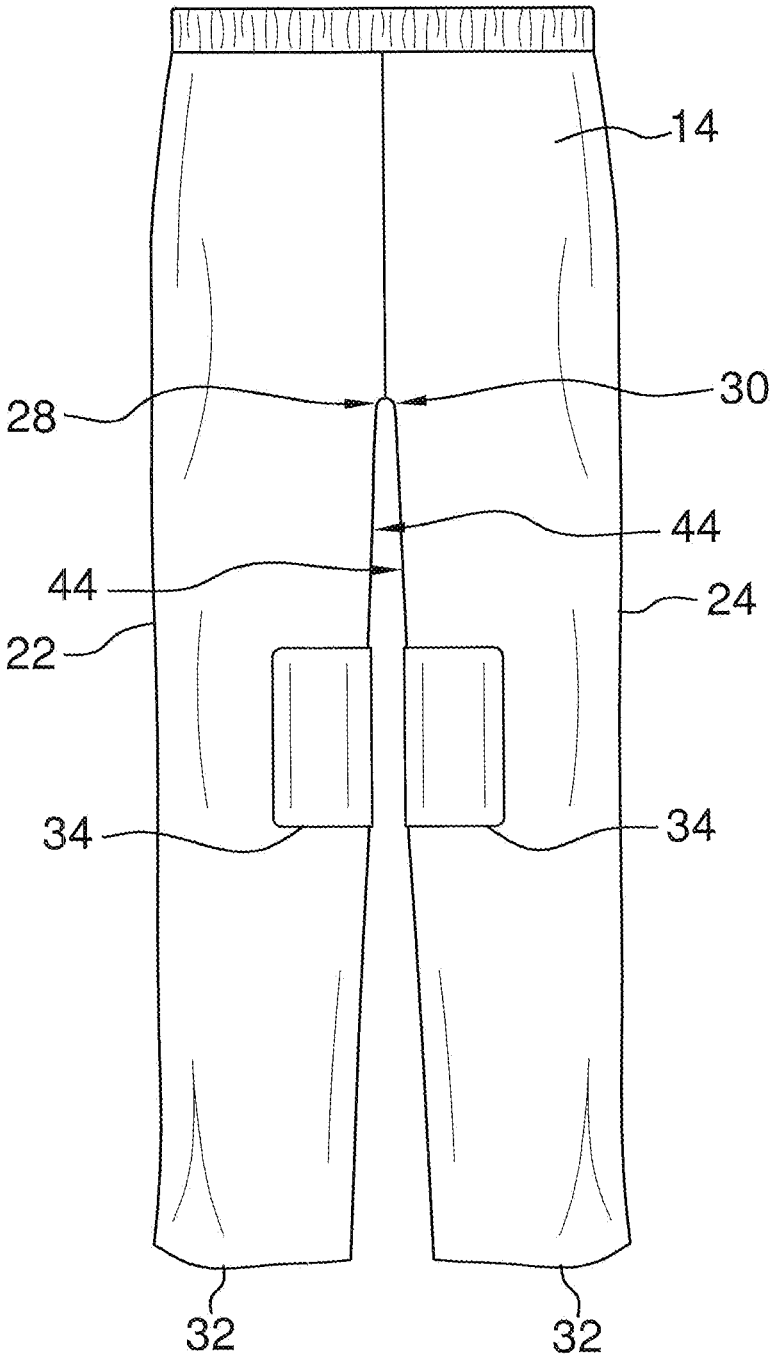
FIG. 2 is a front view of an embodiment of the disclosure.
Figure 3:
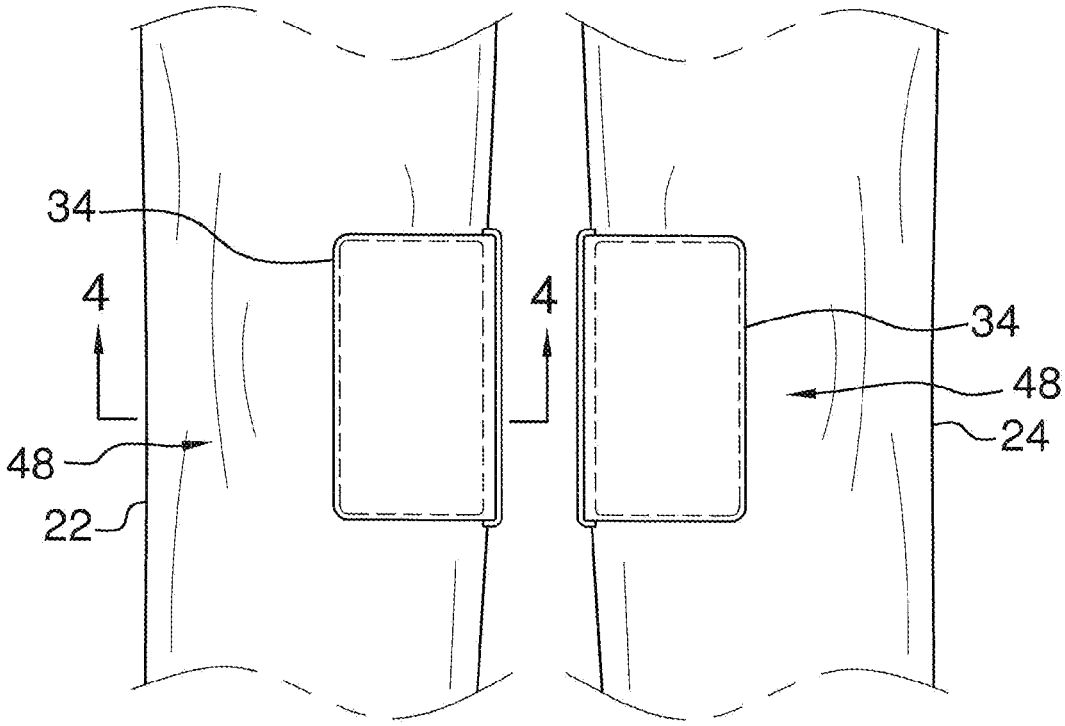
FIG. 3 is a back view of an embodiment of the disclosure.
Figure 4:
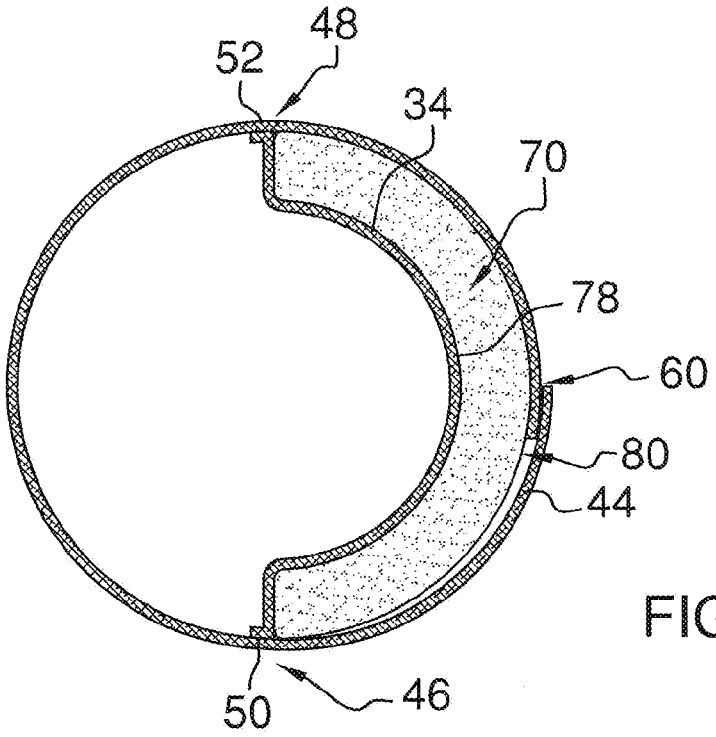
FIG. 4 is a cross-sectional view of an embodiment of the disclosure taken along line 4-4 of FIG. 3.
Figure 5:
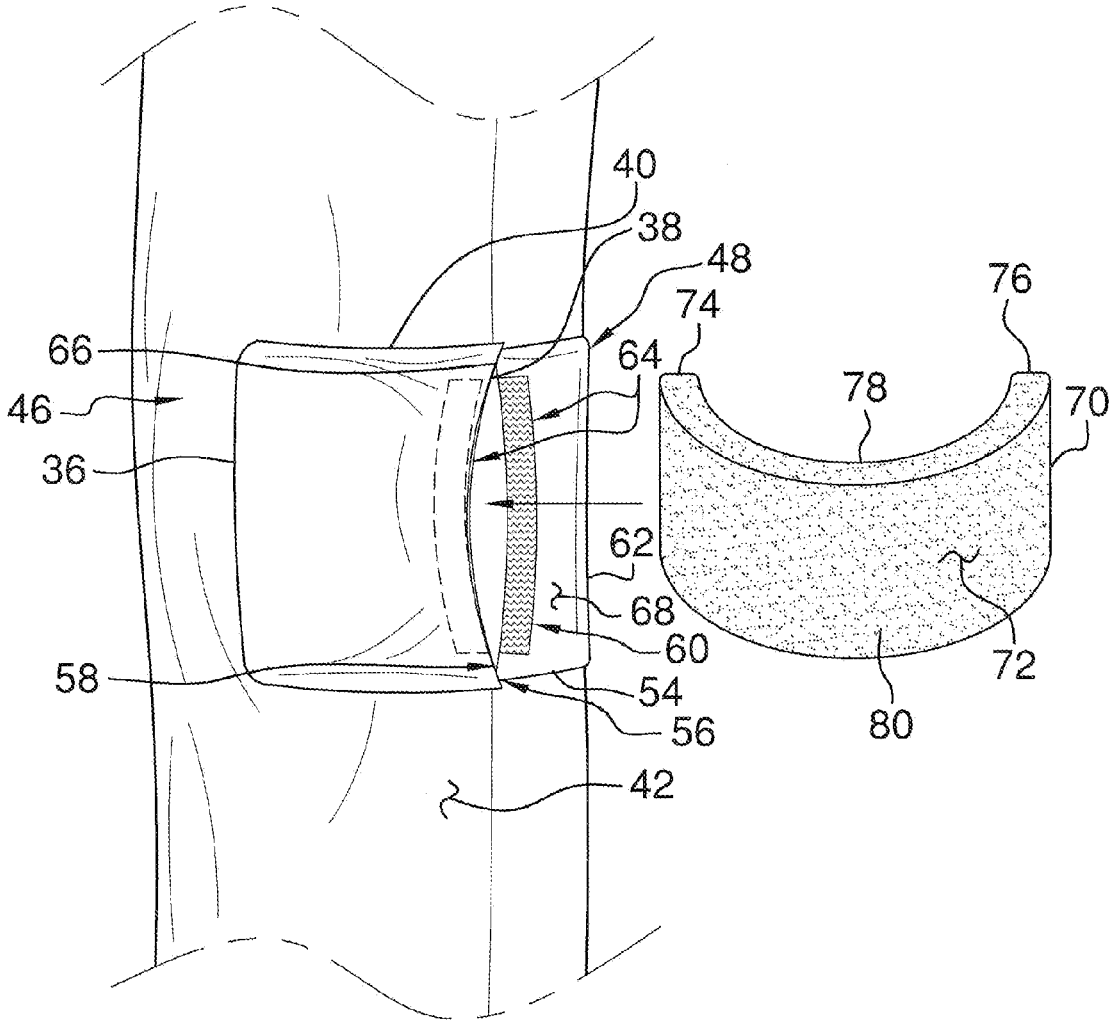
FIG. 5 is a side view of a pant leg of an embodiment of the disclosure.

With reference now to the drawings, and in particular to FIGS. 1 through 5 thereof, a new garment assembly embodying the principles and concepts of an embodiment of the disclosure and generally designated by the reference numeral 10 will be described.

As best illustrated in FIGS. 1 through 5, the knee-spacing garment assembly 10 generally comprises a main section 12 having a front portion 14 and a back portion 16. The front portion 14 is coupled to the back portion 16 and may be done so either integrally or by sewing pieces of fabric together. The main section 12 has a top opening 18 wherein the top opening 18 is configured for being worn around a waist 20 of a user. A first pant leg 22 and a second pant leg 24 are provided. The main section 12 and the pant legs 22, 24 define a garment 26, such as pajama pants or the like. The first pant leg 22 has a top end 28 coupled to the main section 12. Similarly, the second pant leg 24 has a top end 30 coupled to the main section 12. Each of the pant legs 22, 24 has a bottom end 32 positioned opposite an associated one of the top ends 28, 30. Each of the top 28, 30 and bottom ends 32 is open wherein the pant legs 22, 24 are configured for receiving legs of the user when the user wears the garment 26 on the user's lower body. Each of the first 22 and second 24 pant legs are preferably elongated and configured to extend downwardly toward an ankle region of the user.

A pocket 34 is coupled to each of the pant legs 22, 24. Each of the pockets 34 has a closed first end 36, an open second end 38, and a perimeter wall 40 coupled to and extending between the closed first end 36 and the open second end 38. The pockets 34 are preferably coupled to an exterior surface 42 of the pant legs 22, 24. Each of the pockets 34 is coupled to an inner side 44 of the exterior surface 42 of an associated one of the pant legs 22, 24. Each of the pockets 34 preferably extends from a knee region. 46 of the front portion 14 to a knee region 48 of the back portion 16 wherein the knee regions 46, 48 are configured for fully covering knees of the user when the garment 26 is worn on the user's lower body. Each of the pockets 34 may extend between a horizontal midpoint 50 of the knee region 46 of the front portion 14 to a horizontal midpoint 52 of the knee region 48 of the back portion 16. Indicia may be positioned on the garment 26 or on the pockets 34.

A cover 54 may be coupled to the open second end 38 of each of the pockets 34. The cover 54 is positionable to fold over and close the open second end 38. A rear edge 56 of the cover 54 is coupled to a back edge 58 of the open second end 38. A fastener 60 preferably couples a front bottom edge 62 of the cover 54 to the pocket 34. The fastener 60 may comprise complementary portions 64 of hook and loop fastener or may comprise snaps, buttons, zippers, or the like. One of the complementary portions 64 of hook and loop fastener is preferably coupled to the perimeter wall 40 of the pocket 34 proximate a front edge 66 of the open second end 38. One of the complementary portions 64 of hook and loop fastener may be coupled to an interior surface 68 of the cover 54 proximate the front bottom edge 62 of the cover 54. The complementary portions 64 of hook and loop fastener are selectively positionable to couple the front bottom edge 62 of the cover 54 to the perimeter wall 40 of the pocket 34.

A pair of wedges 70 is provided. Each of the wedges 70 is removably positionable into one of the pockets 34 wherein the wedges 70 are configured to facilitate spacing between the user's knees when the wedges 70 are positioned in each of the pockets 34 and the garment 26 is worn on the user's lower body. In this manner, the wedges 70 help space a user's knees while the user is positioned on his or her side while also keeping both back and hips of the user aligned as well. The removable nature of the wedges 70 permits laundering and easy storage of the garment 26. The wedges 70 are preferably concavely arcuate wherein the wedges 70 are configured to be retained in the pockets 34 when a user wearing the garment 26 changes position. Thus, each of the wedges 70 is semi-circular in shape. The wedges 70 may be comprised of a resiliently compressible material 72, such as polyurethane or other similar firm material. Each of the wedges 70 has a first end 74 spaced from a second end 76 and a medial portion 78 extending between the first 74 and second 76 ends. The wedges 70 preferably have a uniform thickness between the first end 74 and the second end 76. Each of the wedges 70 may have the same length and width as the pocket 34. An outer surface 80 of each of the medial portions 78 abuts the open second end 38 of the pockets 34 when each of the wedges 70 is positioned in an associated one of the pockets 34.

Each of the wedges 70 has a length between approximately 5 centimeters and 40 centimeters and a thickness between approximately 2 centimeters and 20 centimeters. Each of the pockets 34 has a length between approximately 5 centimeters and 40 centimeters. Preferably, the wedges 70 are sized to extend fully across the pockets 34, though smaller wedges 70 are also contemplated.

In use, as stated above and shown in the Figures, the garment 26 is positioned on the lower body of the user. Each of the wedges 70 is then positioned in an associated one of the pockets 34. The cover 54 on each of the pockets 34 is positioned to fold over and close the open second end 38 of each of the pockets 34. In this manner, the wedges 70 will remain inside the pockets 34 and cannot move or be misplaced while a user sleeps. The assembly 10 is especially helpful for users with back, knee, or hip ailments or who are recovering from surgeries involving one or more of those regions.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A knee-spacing garment assembly comprising:

a main section, said main section having a front portion and a back portion, said front portion being coupled to said back portion, said main section having a top opening wherein said top opening is configured for being worn around a waist of a user;

a first pant leg and a second pant leg, wherein said main section and said pant legs define a garment, each of said first and second pant legs having a top end coupled to said main section, each of said pant legs having a bottom end positioned opposite an associated one of said top ends, each of said top and bottom ends being open wherein said pant legs are configured for receiving legs of the user when the user wears said garment on the user's lower body;

a respective pocket coupled to each of said pant legs, each of said pockets being positioned on and accessible through an inner side of said exterior surface of an associated one of said pant legs, each of said pockets extending from a knee region of said front portion to a knee region of said back portion wherein said knee regions are configured for fully covering between the user's knees when said garment is worn on the user's lower body, each of said pockets extending between a horizontal midpoint of said knee region of said front portion to a horizontal midpoint of said knee region of said back portion; and a pair of wedges, each of said wedges being positioned in one of said pockets wherein said wedges are configured to be positioned between the user's knees to facilitate spacing between the user's knees when said wedges are positioned in each of said pockets and said garment is worn on the user's lower body.

2. The assembly of claim 1, further comprising each of said first and second pant legs being elongated.

3. The assembly of claim 1, further comprising:

each of said pockets having a closed first end, an open second end, and a perimeter wall coupled to and extending between said closed first end and said open second end; and a cover coupled to said open second end of each of said pockets, said cover being positionable to fold over and close said open second end, a rear edge of said cover being coupled to a back edge of said open second end.

4. The assembly of claim 3, further comprising said cover being removably coupled to said open second end of each of said pockets.

5. The assembly of claim 4, further comprising a fastener coupling a front bottom edge of said cover to said pocket such that each of said wedges are removably positionable into one of said pockets.

6. The assembly of claim 5, further comprising said fastener comprising complementary portions of hook and loop fastener, said complementary portions of hook and loop fastener being selectively positionable to couple said front bottom edge of said cover to said perimeter wall of said pocket.

7. The assembly of claim 6, further comprising one of said complementary portions of hook and loop fastener being coupled to said perimeter wall of said pocket proximate a front edge of said open second end, one of said complementary portions of hook and loop fastener being coupled to an interior surface of said cover proximate said front bottom edge of said cover.

8. The assembly of claim 1, further comprising said wedges being comprised of a resiliently compressible material.

9. The assembly of claim 1, further comprising:

each of said wedges having a first end spaced from a second end and a medial portion extending between said first and second ends; and wherein said wedges having a uniform thickness between said first end and said second end.

10. The assembly of claim 1, further comprising:

each of said wedges having a first end spaced from a second end and a medial portion extending between said first and second ends; and an outer surface of each of said medial portions abutting an open second end of said pockets when each of said wedges is positioned in an associated one of said pockets.

11. The assembly of claim 1, further comprising each of said wedges having the same length and width as said pockets.

12. A knee-spacing garment assembly comprising:

a main section, said main section having a front portion and a back portion, said front portion being coupled to said back portion, said main section having a top opening wherein said top opening is configured for being worn around a waist of a user;

a first pant leg and a second pant leg, wherein said main section and said pant legs define a garment, said first pant leg having a top end coupled to said main section, said second pant leg having a top end coupled to said main section, each of said pant legs having a bottom end positioned opposite an associated one of said top ends, each of said top and bottom ends being open wherein said pant legs are configured for receiving legs of the user when the user wears said garment on the user's lower body, each of said first and second pant legs being elongated;

a respective pocket coupled to each of said pant legs, each of said pockets having a closed first end, an open second end, and a perimeter wall coupled to and extending between said closed first end and said open second end, each of said pockets being positioned on and accessible through an inner side of said exterior surface of an associated one of said pant legs, each of said pockets extending from a knee region of said front portion to a knee region of said back portion wherein said knee regions are configured for fully covering between the user's knees when said garment is worn on the user's lower body, each of said pockets extending between a horizontal midpoint of said knee region of said front portion to a horizontal midpoint of said knee region of said back portion;

a cover coupled to said open second end of each of said pockets, said cover being positionable to fold over and close said open second end, a rear edge of said cover being coupled to a back edge of said open second end;

a fastener coupling a front bottom edge of said cover to said pocket, said fastener comprising complementary portions of hook and loop fastener, one of said complementary portions of hook and loop fastener being coupled to said perimeter wall of said pocket proximate a front edge of said open second end, one of said complementary portions of hook and loop fastener being coupled to an interior surface of said cover proximate said front bottom edge of said cover, said complementary portions of hook and loop fastener being selectively positionable to couple said front bottom edge of said cover to said perimeter wall of said pocket; and a pair of wedges, each of said wedges being removably positionable into one of said pockets wherein said wedges are configured to be positioned between the user's knees to facilitate spacing between the user's knees when said wedges are positioned in each of said pockets and said garment is worn on the user's lower body, said wedges being comprised of a resiliently compressible material, each of said wedges having a first end spaced from a second end and a medial portion extending between said first and second ends, said wedges having a uniform thickness between said first end and said second end, each of said wedges having the same length and width as said pockets, an outer surface of each of said medial portions abutting said open second end of said pockets when each of said wedges is positioned in an associated one of said pockets.

* * * * *